United States Patent [19]

Hughes

[11] Patent Number: 4,577,681

[45] Date of Patent: Mar. 25, 1986

[54] HEAT EXCHANGER HAVING A TURBULATOR CONSTRUCTION

[75] Inventor: Dennis R. Hughes, Germantown, Wis.

[73] Assignee: A. O. Smith Corporation, Milwaukee, Wis.

[21] Appl. No.: 662,346

[22] Filed: Oct. 18, 1984

[51] Int. Cl.[4] ..... F28F 13/12

[52] U.S. Cl. ..... 165/109.1; 138/38; 165/174

[58] Field of Search ..... 165/109 T, 177, 179, 165/174; 138/38; 366/336, 337

[56] References Cited

U.S. PATENT DOCUMENTS

| | | | |
|---|---|---|---|
| 2,359,288 | 10/1944 | Brinen | 138/38 |
| 2,492,298 | 12/1949 | Lenning | 165/179 X |
| 2,591,398 | 4/1952 | Brock | 138/38 X |
| 2,691,991 | 10/1954 | Schutt et al. | 138/38 |
| 2,826,220 | 3/1958 | Young | 138/38 |
| 2,852,042 | 9/1958 | Lynn | 165/109 T X |
| 3,269,420 | 8/1966 | Woodling | 138/38 |
| 3,439,737 | 4/1969 | Boorman et al. | 165/109 |
| 3,589,438 | 6/1971 | Boorman et al. | 165/109 |
| 3,923,288 | 12/1975 | King | 366/336 |
| 3,942,765 | 3/1976 | Henrickson | 366/336 |
| 4,044,796 | 8/1977 | Smick | 165/179 X |
| 4,106,558 | 8/1978 | Neueux | 165/174 X |

FOREIGN PATENT DOCUMENTS 16104 of 1905 United Kingdom ..... 138/38

*Primary Examiner*—Albert W. Davis, Jr.
*Assistant Examiner*—Randolph A. Smith
*Attorney, Agent, or Firm*—Andrus, Sceales, Starke & Sawall

[57] ABSTRACT

A heat exchanger for a combustion unit having particular use with a water heater. The heat exchanger includes a plurality of generally parallel tubes disposed in a water heater tank in contact with the water to be heated and waste gases of combustion pass through the heat exchanger tubes. A turbulator is disposed in each tube to increase the heat transfer from the waste gases to the water in the tank. Each turbulator is formed from a generally flat strip of metal and has a plurality of transverse slits that extend more than one-half the width of the strip and terminate at a base. Generally triangular portions or tabs bordering each slit are bent outwardly and the tabs are disposed generally normal to the strip. One tab bordering each slit extends laterally from one side of the strip, while the other tab bordering that slit extends laterally from the opposite side of the strip. The end portion of the strip is bent about the base of a slit to position the end portion at an angle of about 30° with respect to the remainder of the strip. The bent end portion enables the strip to be firmly engaged within the heat exchanger tube so that it will not be displaced during service and yet can be readily removed for maintenance or replacement.

4 Claims, 6 Drawing Figures

FIG. 1
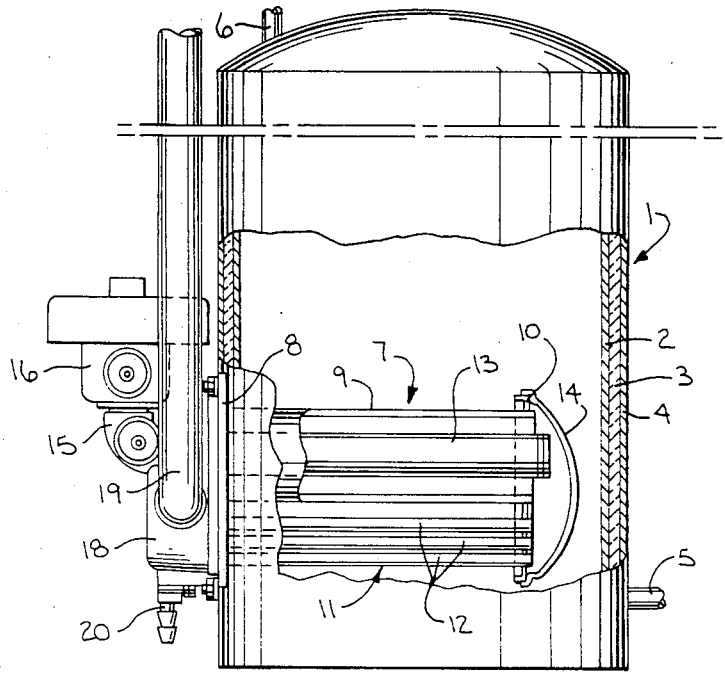
FIG. 2
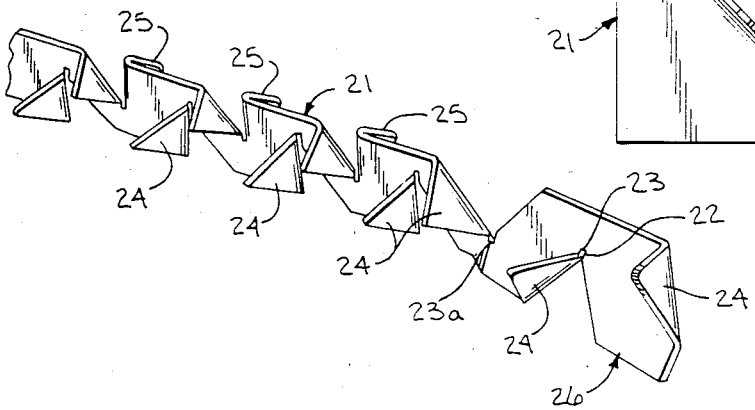
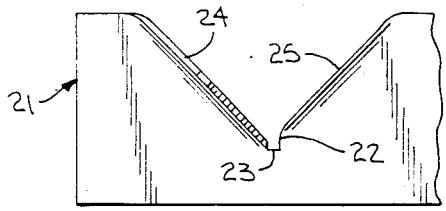
FIG. 6
FIG. 3
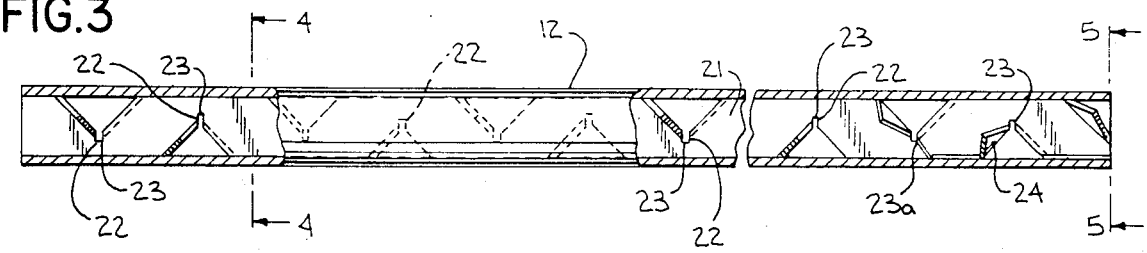
FIG. 4
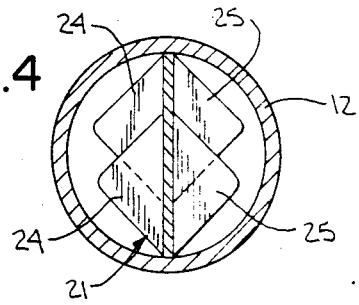
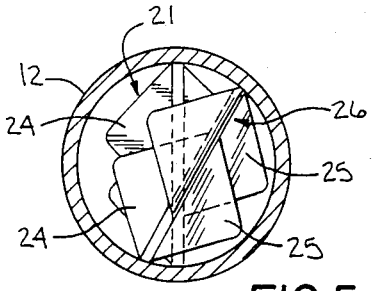
FIG. 5

HEAT EXCHANGER HAVING A TURBULATOR CONSTRUCTION

BACKGROUND OF THE INVENTION

In a conventional gas fired water heater, the gas burner is located beneath the lower head of the tank and waste gases of combustion from the burner pass upwardly through one or more flues that extend through the tank. With this construction, heat is transferred from the lower burner through the head to the water in the tank, as well as from the waste gases passing through the flues to the water.

In an attempt to increase the efficiency of the water heater, heaters have been constructed with an enclosed combustion chamber that is located within the lower portion of the tank in direct contact with the water. With this type of heater, waste gases from the combustion chamber are passed through a heat exchanger also located within the tank, so that additional heat from the waste gases is transferred to the water. Cooling of the waste gases through heat transfer generates substantial quantities of condensate, and in the typical submerged chamber water heater, the condensate is delivered to a collector and is discharged through a condensate trap.

In order to improve the efficiency of operation, it is desired to create turbulence within the heat exchanger tubes, for turbulence increases the rate of heat transfer, and correspondingly increases the rate of condensation of water vapor. As condensation is a heat generating process, the heat produced through condensation can be utilized to further increase the efficiency of operation.

To create turbulence in heat exchanger tubes, various forms of baffles or turbulators have been utilized. The baffles or turbulators should not only increase turbulence, but they should not produce undesirable back pressure and must be able to withstand severe environmental conditions. For example, at the inlet end of the heat exchanger tubes, the temperature of the waste gases may be in the range of about 1300° F. and the gases are dry. However, at the downstream end of the heat exchanger tubes the temperature is substantially lower, but the turbulators are subjected to acidic condensate. Thus, the turbulators must be able to withstand high elevated dry temperatures, as well as acidic environments.

As a further requirement, the turbulators should be firmly mounted within the heat exchanger tubes, yet must be removable for maintenance or replacement.

SUMMARY OF THE INVENTION

The invention is directed to a heat exchanger including a novel turbulator structure and having particular use with a heating unit for a water heater. In accordance with the invention, the turubulators are formed from generally flat strips of metal and have a plurality of transverse slits which extend more than one half the width of the strip and terminate at a base. Generally triangular portions or tabs of the strip bordering each slit are bent outwardly so that the tabs are disposed normal to the strip, with one tab bordering each slit extending laterally from one side of the strip, while the other tab bordering that slit extending laterally from the opposite side of the strip. The tabs lie in planes that are located at an angle of about 45° to a plane longitudinally through the strip.

In order to firmly secure the turbulator within the heat exchanger tube, the end portion of the turbulator is bent or twisted about the base of a slit at an angle of about 25° to 35°. The bent end portion extends radially beyond a circle inscribed through the ends of the strip and will thus firmly engage the tube to retain the turbulator in the tube. However, the turbulator can be readily removed from the tube for maintenance or replacement.

The turbulator of the invention substantially increases the turbulence of gas flow within the heat exchanger tubes and therefore increases heat transfer and condensation which correspondingly increases the overall efficiency of the heating operation.

The turbulator is a simple and inexpensive construction being stamped from a single metal strip.

By virtue of the twisted end portion, the turbulator will be firmly held in the heat exchanger tube, yet can be readily removed for repair or replacement.

Other objects and advantages will appear in the course of the following description.

DESCRIPTION OF THE DRAWINGS

The drawings illustrate the best mode presently contemplated of carrying out the invention.

In the drawings:

FIG. 1 is a diagrammatic view of a water heater incorporating the heat exchanger of the invention;

FIG. 2 is a perspective view of the turbulator;

FIG. 3 is a longitudinal section of the heat exchanger tube containing a turbulator;

FIG. 4 is a section taken along line 4—4 of FIG. 3;

FIG. 5 is a section taken along line 5—5 of FIG. 3; and

FIG. 6 is an enlarged fragmentary plan view of a turbulator.

DESCRIPTION OF THE PREFERRED EMBODIMENT

FIG 1 shows a water heater 1 incorporating the heat exchange unit of the invention. While the drawings illustrate the heat exchange unit as associated with a water heater, it is contemplated that the heat exchanger can be used in other applications where it is desired to increase the turbulence of the heat exchange medium flowing through the heat exchange tubes.

As illustrated in FIG. 1, water heater 1 includes a corrosion resistant tank 2 to contain the water to be heated. Tank 2 may preferably be formed of glass coated steel. Surrounding the tank 2 is an outer jacket 3 and a layer of insulation 4 is positioned between the jacket 3 and tank 2.

Water to be heated is introduced into the tank 2 through an inlet 5 located at the bottom of the tank and heated water is withdrawn from the tank through an outlet 6 located in the upper portion of the tank.

A combustion unit 7 is disposed within the lower portion of the tank and serves to heat the water therein. Combustion unit 7 includes a mounting plate 8 which is secured to the outer surface of tank 2 bordering an opening in the tank. A tubular member 9, defining a combustion chamber, is secured to mounting plate 8 and extends horizontally across the tank 2. The inner end of tubular member 9 is mounted within an opening in end plate 10 and a heat exchange unit 11 is connected between end plate 10 and mounting plate 8 and is located beneath tubular member 9.

As shown in FIG. 1, the heat exchanger 11 includes a bundle of heat exchanger tubes 12 which extend circumferentially around the lower portion of tubular member 9.

A radiant burner 13 is mounted concentrically within the combustion chamber and serves to burn a fuel-air mixture, with the waste gases of combustion flowing outwardly through the outer end of tubular member 9 and being deflected downwardly by deflector 14 into the outer ends of the heat exchanger tubes 12. With this construction, heat is transferred from the combustion chamber to the water in the tank and additional heat is transferred from the waste gases of combustion passing through heat exchanger tubes 12 to the water in the tank.

The fuel-air mixture is supplied to radiant burner 13 through a supply tube 15 and the outer end of the supply tube is connected to the outlet of a blower 16. A gas inlet pipe, not shown, can also be connected in supply tube 15, so that the mixture of air and gas or fuel is supplied through tube 15 to the radiant burner 13. The fuel-air mixture passes through the radiant burner and is ignited on the outer surface of the burner by a standard igniter, not shown.

Cooling of the combustion gases in the heat exchanger tubes 12 produces a substantial quantity of condensate which is collected in a collector 18 mounted on the outside of tank 2. Collector 18 communicates with the inner or downstream ends of heat exchanger tubes 12. Collector 18 is provided with an outlet which is connected to a flue 19 through which the waste gases are conducted to the atmosphere.

The collector 18 can also be provided with a condensate trap 20 which permits the discharge of condensate to a suitable drain while preventing the discharge of waste gases to the atmosphere.

In accordance with the invention, a turbulator 21 is mounted within each of the heat exchanger tubes 12. As best shown in FIGS. 2 and 3, each turbulator 21 is formed of a metal strip, preferably 310 stainless steel. The turbulator is formed with a plurality of transverse slits 22 that extends more than half-way through the width of the strip, as shown in FIG. 6. Each slit 22 terminates at a base 23.

Generally triangular tabs 24 and 25 bordering each slit 22 are bent outwardly at an angle of about 90° with respect to the strip. Triangular tabs 24 extend outwardly from the strip in one direction while the tabs 25 extend outwardly from the strip in the opposite direction. As shown in FIGS. 2 and 6, the triangular tabs 24 and 25 lie in planes that are disposed at an angle of about 45° with respect to a plane extending transversely to said strip and extending through the slit 22.

In order to secure the turbulator within the tube 12 and yet enable the turbulator to be removed for maintenance or replacement, the end portion of each turbulator, indicated by 26, is bent or twisted about the base 23*a* of a slit 22. The end portion 26 is twisted to an angle of about 25° to 30° and preferably about 30°. As the bend is about the base 23*a*, which is not located at the midpoint of the width of the strip, the tip of the end portion 26 will project outwardly beyond a circle enscribed through the ends of the strip 21. When the strip is inserted into the tube 12 the biasing effect of the end portion 26 will retain the turbulator in the tube so that the turbulator will not migrate longitudinally within the tube during heating cycles. The bent end portion also prevents movement of the turbulator during shipment, due to vibration or tilting of the exchanger.

The turbulator of the invention is of simple and inexpensive construction, being stamped from a single metal strip. By virtue of the twisted end portion, the turbulator will be firmly held in the tube and yet can be readily replaced for maintenance and repair.

Due to the angularly extending tabs 24 and 25, the turbulence of the gas flowing within the tube is greatly increased without producing a significant flow restriction, thereby increasing the heat transfer and improving the overall efficiency of the heating operation.

As the turbulator is preferably fabricated from 310 stainless steel, it is capable of withstanding the high temperatures encountered at the upstream end of the heat exchanger, as well as withstanding the corrosive environment encountered at the downstream end of the heat exchanger.

Various modes of carrying out the invention are contemplated as being within the scope of the following claims particularly pointing out and distinctly claiming the subject matter which is regarded as the invention.

I claim:

1. In a heat exchanger, a generally cylindrical tube, a turbulator freely disposed in said tube, said turbulator comprising a generally flat strip of metal having a plurality of spaced transverse slits, each of said slits extending from a side edge of the strip more than one-half the width of the strip and terminating at a base, generally triangular edge portions of said strip bordering each slit being disposed generally normal to the strip, a first edge portion bordering each slit extending laterally from one side of the strip and a second edge portion bordering said slit extending laterally from the opposite side of said strip, an end portion of the strip extending from the base of one of said slits to a corresponding end of the strip being disposed at an acute angle to the remainder of the strip, said end portion being firmly engaged with said tube to retain the turbulator in said tube.

2. The heat exchanger of claim 1, wherein said acute angle is in a range of 25° to 35°.

3. The heat exchanger of claim 1, wherein said metal strip is formed of 310 stainless steel.

4. In a heat exchanger a generally cylindrical tube having an internal surface, a turbulator disposed in said tube, said turbulator comprising a generally flat strip of metal having a plurality of spaced transverse slits, each of said slits extending from a side edge of the strip more than one-half the width of the strip and terminating at a base, generally triangular edge portions of said strip bordering each slit being disposed generally normal to the strip, a first edge portion bordering each slit extending laterally from one side of the strip and a second edge portion bordering said slit extending laterally from the opposite side of said strip, an end portion of the strip extending from the base of one of said slits to a corresponding end of the strip being disposed at an acute angle to the remainder of the strip, said bent end portion when said turbulator is unassembled with said tube having an outer extremity projecting outwardly beyond a circle enscribed through transverse ends of said remainder of said strip, said bent end portion being firmly engaged with the internal surface of said tube to retain the turbulator within said tube.

* * * * *